United States Patent [19]

McConnell

[11] Patent Number: 4,911,088

[45] Date of Patent: Mar. 27, 1990

[54] ASH REDUCTION CHAMBER AND METHOD OF UTILIZING SAME

[75] Inventor: Clifford T. McConnell, Birmingham, Ala.

[73] Assignee: McConnell Industries, Inc., Trussville, Ala.

[21] Appl. No.: 350,546

[22] Filed: May 11, 1989

[51] Int. Cl.[4] ..... F23B 7/00

[52] U.S. Cl. ..... 110/233; 110/214; 110/244; 110/346; 110/347

[58] Field of Search ..... 110/244, 264, 214, 346, 110/347, 233

[56] References Cited

U.S. PATENT DOCUMENTS 3,552,331 1/1971 Widdig ..... 110/244 R 3,837,303 9/1974 Baardson ..... 110/244

4,462,318 7/1984 Carbeau et al. ..... 110/238

4,553,285 11/1985 Sachs et al. ..... 110/244 XR

*Primary Examiner*—Edward G. Favors

*Attorney, Agent, or Firm*—Jennings, Carter, Thompson & Veal

[57] ABSTRACT

A method and apparatus for reducing the residual ash from a cyclonic wood by-products burner utilizes an expanded combustion chamber directly connected to the burner outlet to maintain the exhausted air within chamber at a temperature of 2200 degrees to 2400 degrees F for an extended dwell time as compared to previous devices to complete combustion of the ash residue and lessen deposits on the contents of a downstream kiln.

11 Claims, 2 Drawing Sheets

ASH REDUCTION CHAMBER AND METHOD OF UTILIZING SAME

FIELD OF THE INVENTION

The present invention relates generally to the field of wood residue utilization, and more particularly to the field of utilization of wood residue as fuels for dryers of various types, particularly for wood products.

DESCRIPTION OF THE PRIOR ART

The most pertinent prior art is U.S. Pat. No. 3,777,678 issued to Lutes et al. That patent covers a cyclonic type fuel burner which is used to burn suspended wood residue particulate. To make the burner operative in the kiln or rotary dryer application, it was found that a burner extension was necessary, thus the assignee of the instant application has heretofore added a limited volume extension intermediate the suspension burner and the dryer. The extension is a cylindrical unit of refractory material and an outer encasement of metal which is internally separated from the burner by a radially inwardly injected air curtain. While this arrangement has heretofore been satisfactory, a problem persists in the amount of ash or residue carried through the extension into the dryer and deposited on the drying lumber. The amounts of deposited residue is clearly visible with the naked eye and gives the dried lumber a grayish appearance. The grayish appearance is cosmetic only and is of no particular importance because the lumber is generally passed through a planer which removes the residue along with the portion of the lumber planed away. However, the residue does contribute to the volume of particulate matter generated by the planer and consequently increases the difficulty in controlling the dust and particulate matter content of the region about the planer which is an irritation and concern for the workers who operate the timber processing machinery.

Various solutions to the problem have been suggested including: adding water sprays to the dryers, which increases drying time; pneumatically removing the residue prior to planing, which simply creates a second dust collection problem; and increasing the temperature of the burner extension to create a residual heavy slag in the extension which could be removed therefrom.

The obvious drawback of water sprays and pneumatic removal led to experimentation in slag formation. In these experiments, a standard burner extension was fired to temperatures of between about 2400 degrees F. to 2750 degrees F. with slag forming therein. The air curtain was eliminated and the outlet of the extension was reduced to 19 inches. The residue or ash appeared whiter but remained substantially unchanged in quantity. Thus it appeared that heating the extension chamber sufficiently to create slag formation would not appreciably solve the residue problem.

SUMMARY OF THE INVENTION

The principle object of this invention is to reduce the amount of residue deposited on dried lumber from a dry fuel suspension burner.

Yet another object of the invention is to accomplish the first object without increasing the drying time of the lumber.

The ultimate goal is to provide an efficient drying apparatus with minimal discharge residue content to minimize dust collection problems in subsequent processing procedures.

The foregoing objects have been accomplished in this invention through the use of an extended blend chamber with a larger volume than the burner with the chamber operating at a temperature above 2000 degrees F. yet below the temperature at which slag forms in the chamber.

BRIEF DESCRIPTION OF THE DRAWINGS

Apparatus embodying features of my invention are depicted in the attached drawings which form a portion of this disclosure and wherein.

DESCRIPTION OF THE PREFERRED EMBODIMENT

Although creation of residue bearing slag was not the solution, it was determined that post-burner heating of the residue was helpful in reducing the amount of residue deposited on the lumber. Specifically, it was found that post-burner retention of the combustion gases in an expanded volume chamber at a temperature of between about 2000 degrees and 2300 degrees F. prior to injection into the dryer resulted in appreciably reduced residue deposits without slag formation in the chamber.

Figure 1:
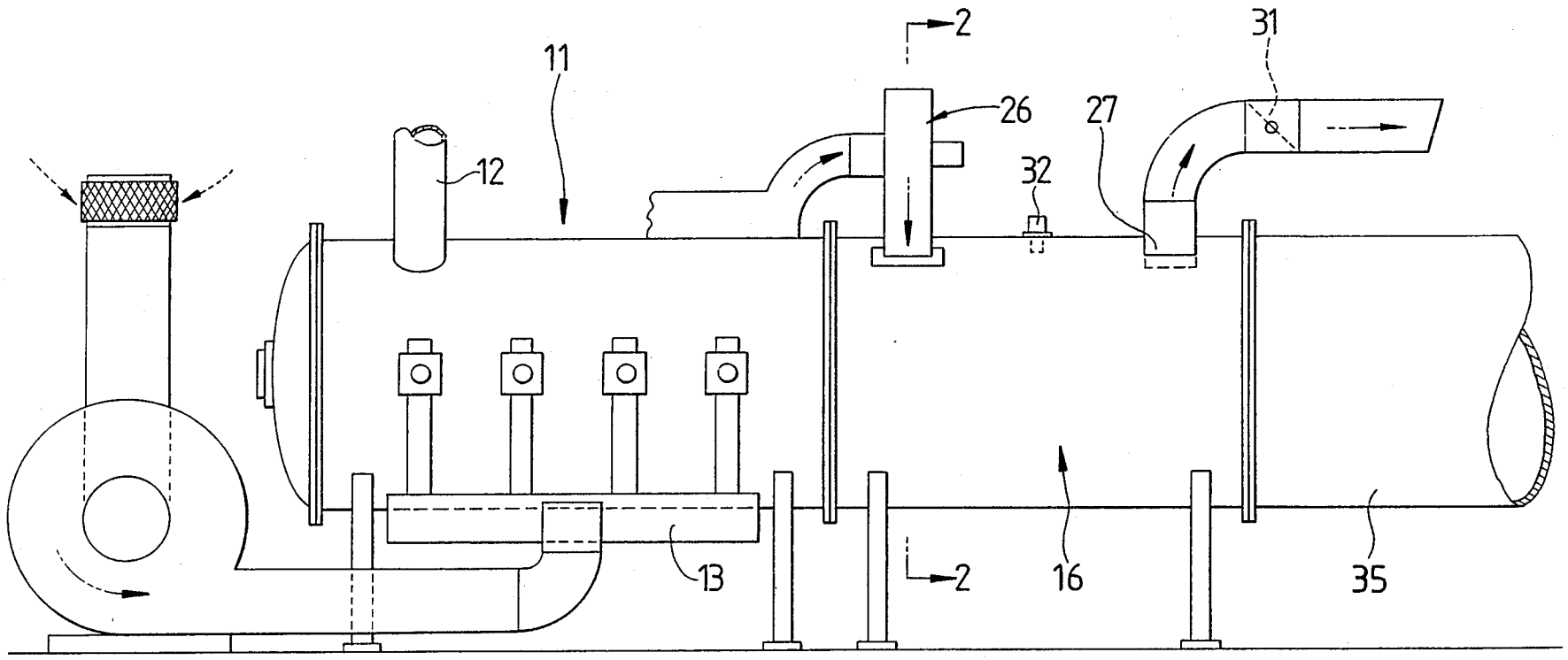
FIG. 1 is a side elevational view showing a suspension burner, my extension chamber and the outlet therefore.
Figure 2:
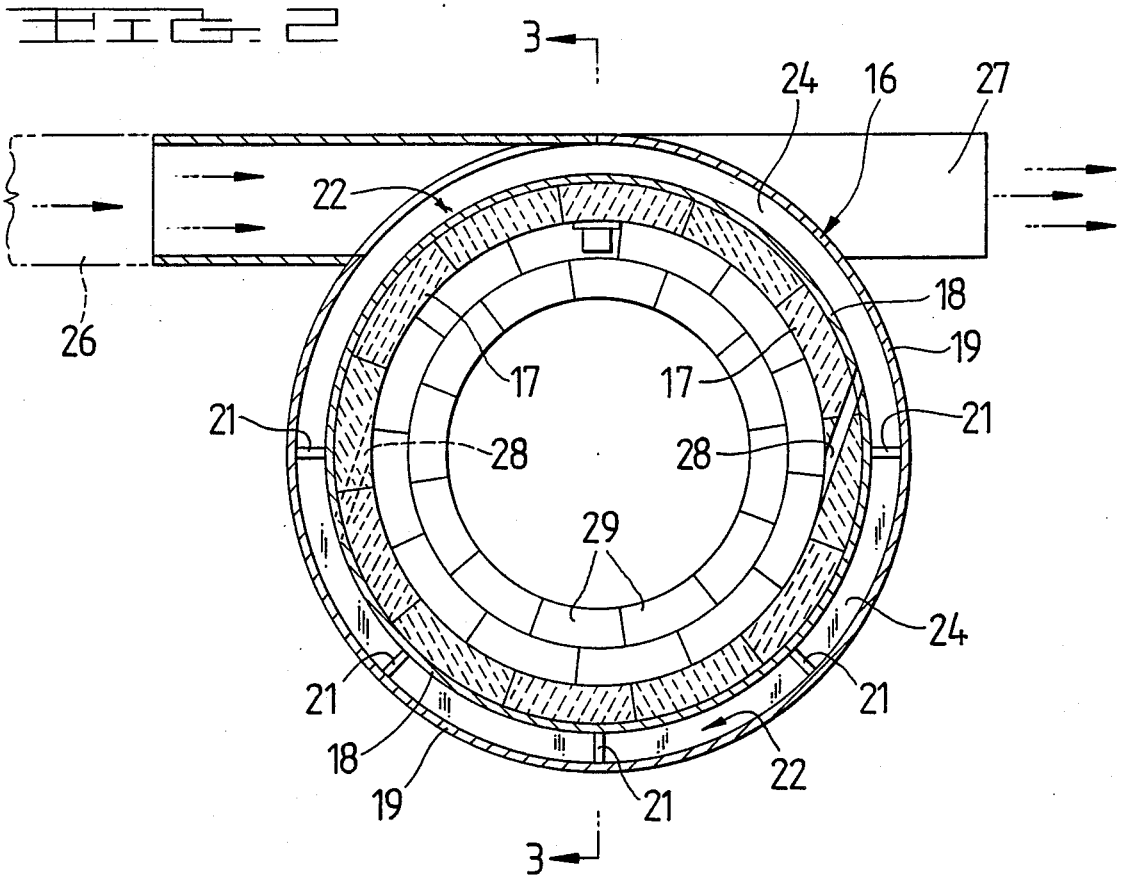
FIG. 2 is a sectional view taken along line 2—2 of FIG. 1.
Figure 3:
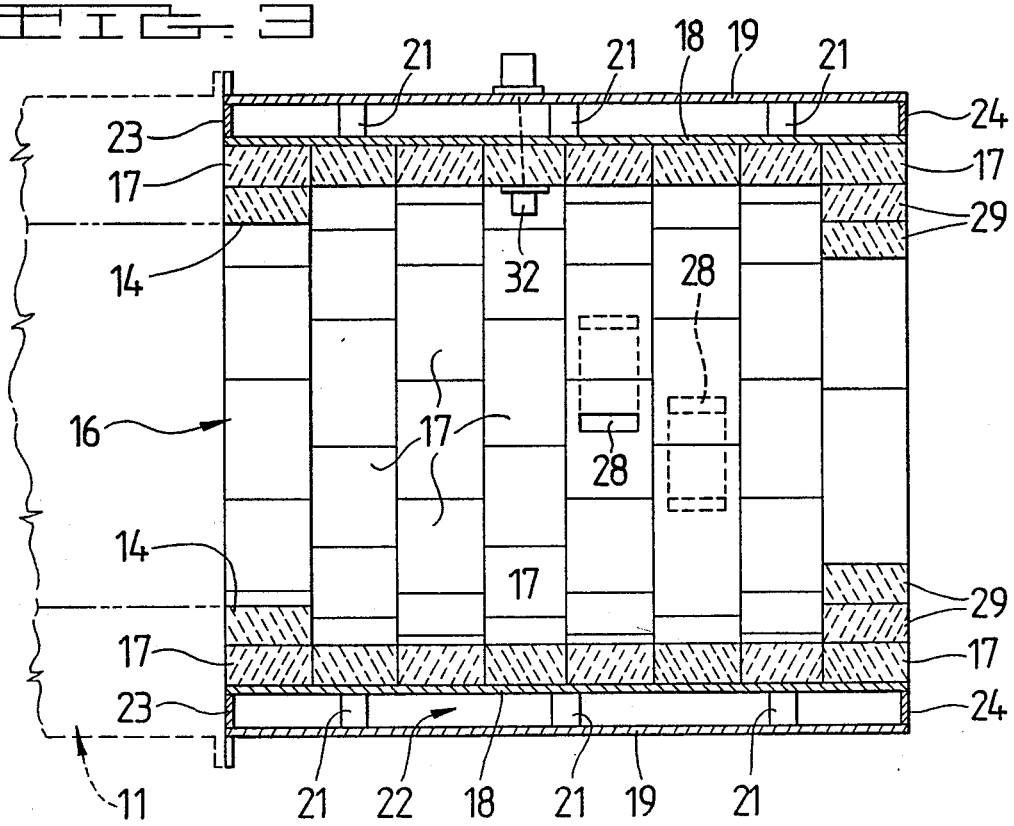
FIG. 3 is a sectional view taken along line 3—3 of FIG. 2.

Referring to FIG. 1, an external view of the burner and my extension with associated fans is presented. A dry suspension burner 11 is depicted with a fuel delivery conduit 12 and an air injection manifold 13 providing the necessary ingredients for combustion. The burner shown at 11 is preferably of the type shown in U.S. Pat. No. 3,777,678 the teachings of which are incorporated herein by reference to explain the operation of the burner 11.

The burner 11 has a discharge outlet, not shown, which is of a reduced diameter compared to the actual combustion chamber of the burner 11. Immediately adjacent the burner outlet the present invention employs a ring 14 of refractory material of equal internal diameter, which leads to an expanded chamber 16 of refractory material 17. In the prototype, the inside diameter of the chamber 16 was 48" with a length of about eight feet to ten feet. The chamber 16 is also encased by a cylinder 18 of metal adjacent the outer surface of the refractory material 17 and a second cylindrical wall 19 held in spaced relation to cylinder 18 by a plurality of spacers 21. Each end of the annular space 22 formed between the cylindrical metal walls is closed by an annular plate 23 and 24. A cooling fan 26, which may be the same fan used in cooling the burner supplies forced air to the annular space 22, a portion of this forced air may be exhausted through vent 27. A plurality of tuyeres 28 are spaced equidistantly about the chamber and provide air injection from the annular space 22 into the chamber, thus maintaining the cyclonic effect. A row of refractory bricks 29 are used to reduce the outlet diameter of the chamber such that the gases therein are under some pressure as said gases exit to drying apparatus 35.

The increased volume of the present invention allows the burnt gases to remain within the blend chamber somewhat longer than the conventional discharge chamber and the new chamber is operated at a higher temperature, i.e. 2000 degrees to 2400 degrees F., by controlling the fire in the burner and by the use of valve 31. Valve 31 is in the discharge vent 27 and can be positioned to modulate the flow of air through the tuyeres 28 and the vent 27. In as much as the temperature optimum is at about 2200 degrees F., we utilize a sensor 32 or set of sensors to monitor the temperature in chamber 16. The sensor 32 is operatively connected to valve 31 to position the valve 31 such that cooling air from fan 26 and annular space 22 is directed into the chamber 16 as required, for cooling at high fire of the burner 11, and to position the valve to dump the cooling through the vent 27 to maintain optimum temperature at low fire. At this level no slag is formed in the chamber, however the ash deposit is almost completely eliminated on lumber dried downstream from the chamber. The difference in lumber treated with the improved method and apparatus is visible to the naked eye. Lumber treated by the prior art exhibits a grayish dusty deposit on its surface, whereas lumber dried in the improved chamber is clean-looking with minimal visible residual deposits. These deposits are easily removed by a blower. While actual measurements have not been performed on the amount of ash reduction, on a typical kiln charge of 120,000 board feet of lumber, approximately 39,000 lbs. of wood by-product fuel is burned with approximately 0.5%, or 195 lbs., remaining as ash in the prior art. Since treatment of the hot gases with the improved chamber results in the ash residue being reduced to a non-visible level, it is reasonable to conclude that the majority of the 195 lbs. previously deposited is consumed in the chamber. Note that the material is not converted to slag, therefore it must pass through the kiln as a combustion by-product which is not deposited on the lumber.

While I have shown my invention in one form, it will be obvious to those skilled in the art that it is not so limited but is susceptible of various changes and modifications without departing from the spirit thereof.

What I claim is:

1. Apparatus for reducing combustion residue from the outlet of a dry fuel suspension burner to a drying apparatus comprising:

(a) a cyclonic post combustion chamber operatively connected to the outlet of a dry fuel suspension burner to receive combustion gases therefrom, said chamber having an outlet end connected to a drying apparatus and having a diameter and length adapted to increase the dwell time of said combustion gases therein;

(b) means for restricting the outlet end of said post combustion chamber; and (c) means for controlling the temperature within said combustion chamber between 2000 and 2400 degrees F.

2. Apparatus as defined in claim wherein said cyclonic post combustion chamber comprises a cylindrical chamber having an internal lining of refractory brick and an internal diameter equal to or grater than the associated dry fuel suspension burner, an air circulation jacket surrounding and spaced from said internal lining, and a plurality of tuyeres providing communication between the interior of said cylindrical chamber and the space between said internal lining and said air circulation jacket, said tuyeres located proximal said outlet end.

3. Apparatus as defined in claim 2 wherein said means for restricting comprises a ring of refractory bricks disposed within said chamber at the outlet thereof.

4. Apparatus as defined in claim 1 wherein the internal diameter of said combustion chamber is larger than the internal diameter of the outlet of said dry fuel suspension burner.

5. The apparatus as defined in claim 4 wherein the inside diameter of the outlet of said post combustion chamber is smaller than the outlet of said dry fuel suspension burner.

6. The apparatus as defined in claim 5 wherein said means for controlling said temperature comprises valve means for controlling the flow of air from said air circulation jacket through said tuyers; and means for sensing the temperature within said cyclonic post combustion chamber operatively connected to said valve to position said valve such that air from said air circulation chamber is selectively directed through said tuyeres to maintain said temperature as desired.

7. A method for reducing combustion residue from a dry fuel suspension burner having an outlet for passage of combustion gases to a drying apparatus, comprising:

(a) introducing said combustion gases to an expansion chamber intermediate said outlet and said drying apparatus, said expansion chamber having an inside diameter greater than the inside diameter of said outlet;

(b) maintaining the temperature of said combustion gases between about 2000 degrees to about 2400 degrees F. while within said expansion chamber;

(c) retaining said combustion gases within said chamber for a sufficient time to complete combustion of residue in said combustion gases; and (d) exhausting said combustion gases into said drying apparatus.

8. The method of claim 6 further comprising maintaining a cyclonic flow of air within said expansion chamber proximal said drying apparatus.

9. A method for reducing combustion residue in a dry fuel suspension burner having an outlet for passage of combustion gases to a drying apparatus, comprising:

(a) retaining the combustion gases in an extended chamber formed immediately adjacent the outlet of said burner for a predetermined period;

(b) maintaining the temperature of the combustion gases between about 2000 to about 2400 degrees F. for a sufficient period to complete combustion of residue in said gases; and (c) exhausting said gases to said drying apparatus.

10. The method of claim 7 wherein said temperature is maintained at about 2000 degrees to 2200 degrees F.

11. A method as defined in claim 7 wherein the temperature within said chamber is sensed and a flow of cooling gases is mixed with said combustion gases within said expansion chamber to maintain said temperature at the desired levels.

* * * * *